United States Patent [19]

Hara

[11] 4,189,698

[45] Feb. 19, 1980

[54] RESETTABLE THERMAL CUT-OFF FUSE

[75] Inventor: Kunio Hara, Kawasaki, Japan

[73] Assignee: Nifco Inc., Kawasaki, Japan

[21] Appl. No.: 949,307

[22] Filed: Oct. 6, 1978

[30] Foreign Application Priority Data

Oct. 8, 1977 [JP] Japan ..... 52-120508

[51] Int. Cl.[2] ..... H01H 37/76

[52] U.S. Cl. ..... 337/407; 337/408

[58] Field of Search ..... 337/404, 407, 408, 409

[56] References Cited

U.S. PATENT DOCUMENTS

| | | | |
|---|---|---|---|
| 2,934,628 | 4/1960 | Massar et al. | 337/409. |
| 2,955,179 | 10/1960 | Milton, et al. | 337/408 X |
| 3,956,725 | 5/1976 | Merrill, et al. | 337/407 |

*Primary Examiner*—George Harris

*Attorney, Agent, or Firm*—Glenn W. Bowen; Robert W. Beart

[57] ABSTRACT

A resettable thermal cut-off fuse, under normal temperature condition, keeps the circuit in a closed state by allowing a switch member which is energized by a spring in the circuit-breaking direction to be joined through the medium of a thermal pellet capable of retaining a solid state under the normal temperature condition to a check means which is prevented from rotating in the spring's energizing direction. When the ambient temperature rises to a prescribed level and, consequently, the thermal pellet melts, the fuse allows the switch member to rotate in the spring's energizing direction to open the circuit. When the ambient temperature falls and returns to its normal level, the fuse can be manually reset by rotating in the circuit-making direction until it resumes firm engagement with the check means to close the circuit.

3 Claims, 12 Drawing Figures

RESETTABLE THERMAL CUT-OFF FUSE

BACKGROUND OF THE INVENTION

This invention relates to a resettable thermal cut-off fuse designed for use in an electrical appliance provided with a heat source and adapted so that it keeps the circuit in a closed state while the appliance remains under its normal temperature condition; when the amount of heat radiated by the appliance abnormally increases so much as to elevate the ambient temperature to a prescribed danger level, the fuse opens the circuit by accurately responding to the change of temperature; and when the ambient temperature falls and returns to the normal level again, the fuse is rendered manually resettable to close the circuit.

Generally, the thermal cut-off fuse fulfils its purpose by breaking its own circuit (which usually provides electrical continuity between a pair of lead wires) at a prescribed temperature. This is done by use of a thermal pellet which changes from a solid state to liquid state at the prescribed temperature. Good many fuses developed to date amply satisfy this function.

The conventional thermal cut-off fuses using such a thermal pellet are of disposable types. Once they serve the purpose of opening the circit upon sensing an abnormal elevation of temperature, they cannot be reset and must be wholly discarded as no longer useful. The well-known bimetal type fuse has one advantage over the thermal cut-off fuse in that it is resettable and, therefore, is more economical. In terms of accuracy of response to temperature change, however, the bimetal type fuse can hardly stand comparison with the thermal cut-off fuse using the thermal pellet which enjoys outstanding accuracy of temperature response. Further the bimetal type fuse is of a self-resetting type and, for this reason, cannot be used as a thermal cut-off fuse. For example, when trouble develops and abnormal heat buildup ensues in an electrical system, the bimetal snaps to open the circuit and prevents further aggravation of the trouble. When the increased heat is dispersed into the ambient air and the temperature of the bimetal returns to a safe level, the bimetal automatically snaps back to close the circuit, whether the trouble has been completely eliminated or not. Unlike the thermal cut-off fuse, therefore, the bimetal is not capable of precluding the continuance of a dangerous temperature condition. This is because the bimetal, by nature, fulfils the sole purpose of temperature control. In contrast, thermal cut-off fuses of simple constructions cannot be reset like the bimetal can. Further, because they are relatively expensive, they are mostly produced in constructions which are not suitable for reuse. If they are manufactured in constructions which permit reuse, these constructions are preferably such that resetting can be done manually after it has been confirmed that the cause of the trouble has been eliminated.

An object of the present invention is to provide a thermal cut-off fuse of a simple construction using a thermal pellet having high accuracy of temperature response, which in use, when inserted in the circuit of an electrical appliance provided with a heat source, keeps the circuit in its closed state under the normal temperature condition, opens the circuit with a high accuracy of response when the ambient temperature reaches the prescribed danger level fixed in accordance with the ratings of the electrical appliance and can be manually reset to close the circuit when the ambient temperature falls and returns to the normal safe level.

SUMMARY OF THE INVENTION

To accomplish the object described above according to the present invention, there is provided a resettable thermal cut-off fuse which comprises a switch member serving to establish electrical continuity between the contacts and energized by a spring in the circuit-breaking direction, a check means to prevent the spring from rotating the energizing direction, and a thermal pellet adapted to melt at the temperature prescribed as danger level and to remain in a solid state under the normal temperature condition to freeze the relative movement of the switch member and the check means.

The switch member which is energized by the spring in the circuit-breaking direction maintains the circuit in its closed state because it is joined to the check means through the medium of the thermal pellet which is solid under the normal temperature condition. As the ambient temperature rises and reaches the prescribed danger level, the thermal pellet melts and releases the switch member from the restraint provided by the check means to open the circuit. When the ambient temperature falls and returns to the normal safe level, the thermal pellet solidifies and seizes firm hold of the check means, so that the switch member may be manually returned to the circuit-making position and retained fast in that position.

When the ambient temperature again rises to reach the prescribed danger level, the fuse opens the circuit in the manner described above. Whenever the circuit is so broken, it can be easily closed by the fuse being manually reset.

Since the thermal pellet used in the fuse has extremely high accuracy of temperature response, it functions as a thermal cut-off fuse with high reliability.

The other objects and characteristic features of the present invention will become apparent from a detailed description to be given herein below with reference to the accompanying drawing.

DESCRIPTION OF THE PREFERRED EMBODIMENT

Figure 1:
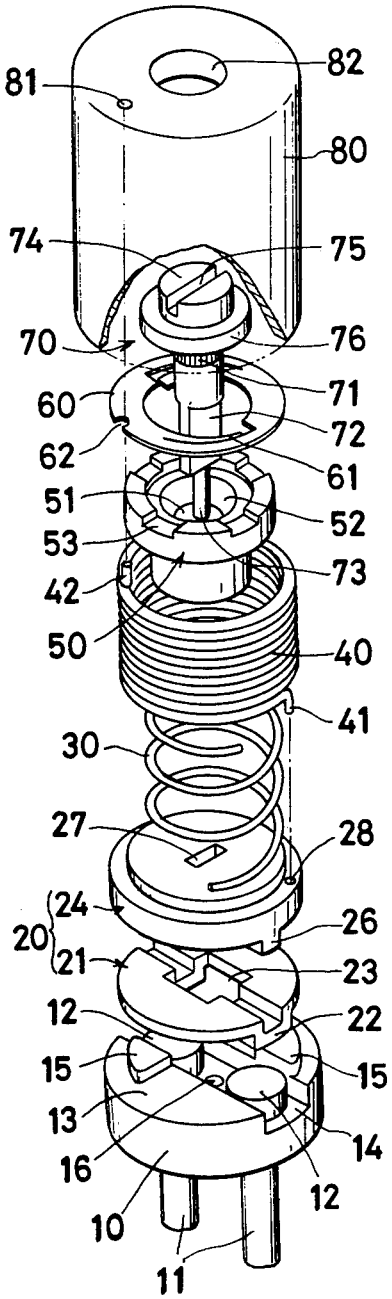
FIG. 1 is an exploded perspective view of one preferred embodiment of the thermal cut-off fuse of the present invention.

The first preferred embodiment of the thermal cut-off fuse is designed so that the presence and absence of electrical continuity through the fuse proper manifest themselves between a pair of lead wires 11. The terminal end of each lead wire is provided with a contact 12. Within a groove 14 is formed in one surface of a base 10, the contacts 12 insulated from each other are disposed so that their upper surfaces are flush with the surface 13 on which contact means 21 rotates in sliding motion. The contact means 21 which is made of an electroconductive material is provided with a contact projection 22 protruding in the direction of the base 10. When the base 10 and the contact means 21 are brought toward each other into engagement from their positions illustrated in FIG. 1, electric continuity is established between the contacts 12 by the contact means through the medium of the contact projection 22 [FIG. 2(A)]. When they brought into engagement with the contact means rotated by an angle of 90° from the position illustrated in FIG. 1, no electric continuity can be established between the contacts 12 [FIG. 2(B)]. Consequently, these two different kinds of engagement between the base 10 and the contact means 21 give rise to the respective state of closed circuit and open circuit. What is raised from the surface 13 of the base 10 is a stopper 15 which serves to prevent the contact means 21 from excessive rotation.

The contact means 21 is supported in position by a contact base 24. The contact means 21 and the contact base 24 both have shapes, generally those of discs, suitable for rotation. To permit their mutual engagement, the contact means 21 is provided at the center with a rectangular hole 23 and the contact base 24 is provided at the center with a rectangular protuberance 25. They are brought into intimate engagement when the rectangular protuberance 25 is inserted in the rectangular hole 23. The contact base 24 is further provided with a ridge 26 adapted to fit in the groove formed in the rear surface of the contact projection 22 of the contact means. When the ridge 26 and the groove are fitted to each other, the contact base 24 and the contact means combine with each other to give rise to a switch member 20.

Figure 4:
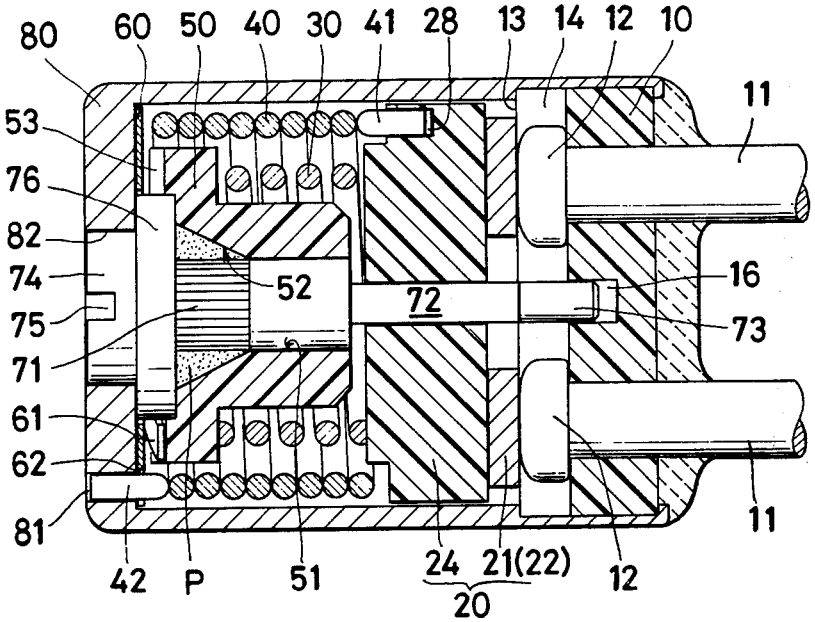
FIG. 4 is a sectioned view in side elevation of the thermal cut-off fuse of FIG. 1, as held in an assembled state.

Further, the switch member 20 is provided in a coaxial positional relationship with a coil spring 40 possessing energizing power capable of rotating the contact means 21 by a fixed angle from the first position [for closed circuit illustrated in FIG. 2(A)] to the second position [for opened circuit illustrated in FIG. 2(B)]. More specifically, as illustrated in FIG. 4, one end 41 of the coil spring 40 is inserted in a hole 28 bored in the contact base 24 and the other end 42 of the coil spring is retained in a hole 81 bored in the top plate of a housing 80 for encasing the entire fuse proper. If the coil spring 40 is twisted so as to rotate the switch means 20 in the direction opposite the circuit-breaking direction and allow it to assume the position of closed circuit as illustrated in FIG. 2(A), it produces an energizing force for rotating the switch member 20 in the circuit-breaking direction [FIG. 2(B)]. Actually under the normal temperature condition, however, the switch member 20 must be kept in the position of closed circuit in spite of the energizing force of the coil spring 40. Purely for this purpose, there is provided a check means which comprises a ratchet means 50, a catch plate 60 and a rotating member 70.

The ratchet means 50 has a perforation 51 bored in the axial direction at the center as illustrated. Inside this perforation 51, the shaft 71 of the rotating member 70 is rotatably set in position. At the outer end of the perforation 51 of the ratchet means 50, there is formed a counter sink 52 in such a manner that a closed space is formed when the shaft 71 of the rotating member 70 is received into the perforation of the ratchet means. Inside this space, a thermal pellet P is placed (FIG. 4).

The thermal pellet P is formulated so that it retains its solid state under the normal temperature condition and melts at a prescribed elevated temperature. The thermal pellet P is ideally suitable for the purpose of the thermal cut-off fuse because it is characterized by accurately responding to the fixed temperature by melting with high accuracy and without fail.

This thermal pellet P is molded in a shape slightly larger than the shape of the space to be enclosed by the ratchet means 50 and the rotating member 70 so that it will be placed tightly in the space when the rotating member 70 and the ratchet means 50 are combined. When the thermal pellet P is in such a solid state, the ratchet means 50 and the rotating member 70 are prevented from producing relative movement to each other and move as if they formed a single integral piece. These two parts rely for their mutual union upon the frictional force produced by the thermal pellet P. To ensure their perfect union under the normal temperature condition, it is desirable that part of the shaft 71 of the rotating member and the wall surface of the counter sink 52 of the ratchet means should be suitably knurled.

The shaft 71 of the rotating member 70 is extended to form an engaging member 72 having a non-circular cross section, which is inserted into an engaging perforation 27 of a matching cross section bored in the contact base 24. Thus, the rotating member 70 and the contact base 24 jointly produce a rotary motion. This means that the rotating member 70 and the switch member 20 cooperate to produce a joint rotary motion. Therefore, as long as the thermal pellet P remains in its solid state the ratchet means 50 rotates jointly with the switch member 20 and the rotating member 70.

Figure 5A:
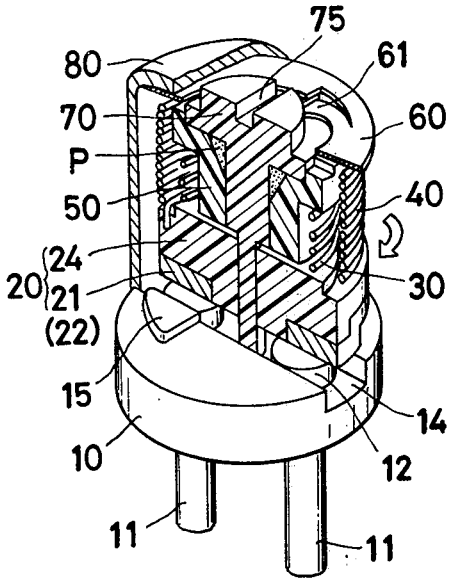
FIGS. 5(A) and (B) are partially cutaway perspective views of the thermal cut-off fuse, as held in respective conditions of closed circuit and opened circuit.
Figure 2:
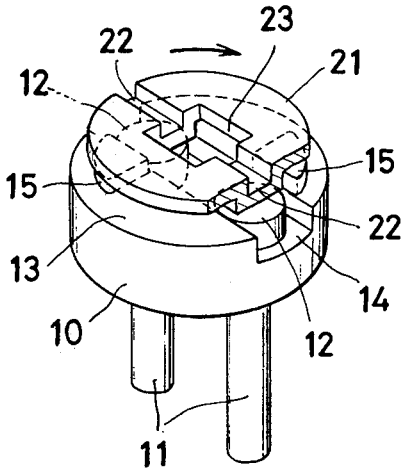
FIGS. 2(A) and (B) are perspective views of the contacts and switch member of the thermal cut-off fuse of FIG. 1, as held in the positions of closed circuit and opened circuit respectively.
Figure 2:
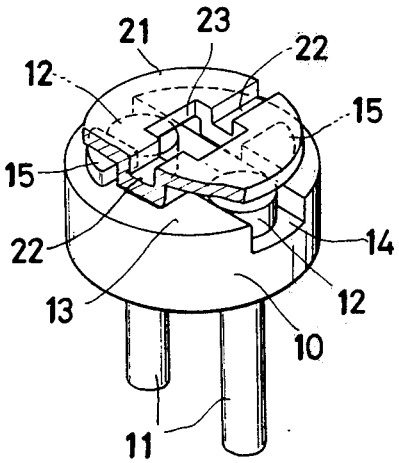
Figure 3:
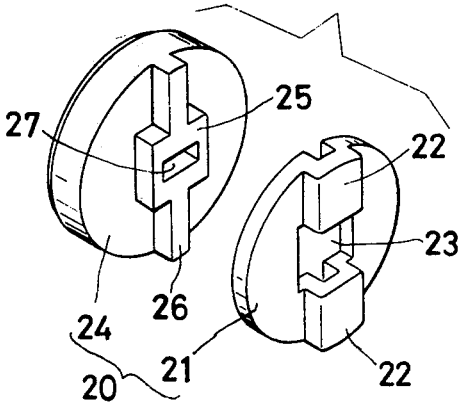
FIGS. 3(A) and (B) are prespective views of a switch member of the thermal cut-off fuse of FIG. 1, as held in separated and combined states respectively.
Figure 3:
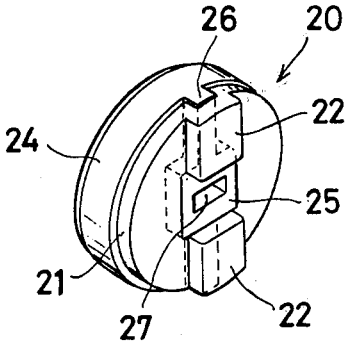

When the component parts mentioned above are encased within the housing 80 so as to satisfy the aforementioned structural conditions as illustrated in FIG. 1, since the one end 42 of the coil spring 40 is fastened to the housing 80 and the other end 41 of the coil spring 40 is connected to the combined group of switch member 20, ratchet means 50 and rotating member 70, the coil spring 40 constantly exerts a force for the combined group to be rotated in the circuit-breaking direction [in the clockwise direction in the position of FIG. 5(A)]. This force is effectively countered by the check means which comprises the ratchet means 50 and the catch plate 60.

The catch plate 60 which is made of a steel material possessing a moderate degree of elasticity is notched so as to form at least one resilient claw 61 and further has a part of its periphery cut out to form a notch 62. When the coil spring 40 is placed inside the housing 80, the notch 62 of the catch plate 60 is hooked on the one end 42 of the coil spring 40 so as to deprive the catch plate 60 of its freedom of rotation. On the upper side of the periphery of the ratchet means 50, grooves 53 are cut at positions spaced by a fixed angle of 90°. When the ratchet means 50 is placed inside the housing 80, therefore, the resilient claw 61 of the catch plate collides with one of the walls of the notched groove 53 and prevents the ratchet means 50 from rotating in the clockwise direction in the position illustrated in the drawing.

In other words, the coil spring 40 exerts upon the switch member 20 a rotary force in the clockwise direction. By virtue of the catch plate 60, however, the ratchet means 50 which is combined with the switch member 20 under the normal temperature condition is prevented from rotating in the clockwise direction. The state of electrical continuity illustrated in FIG. 5(A) is retained when the contact means 21 is incorporated from the beginning in such a manner as to establish continuity between the two contacts 12.

Figure 5B:
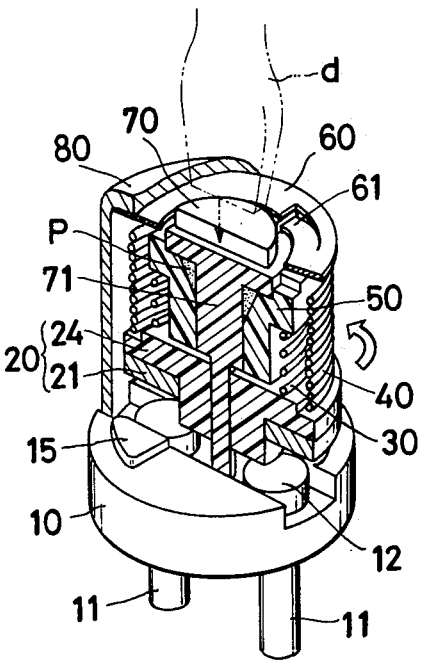

When for some reason or other, the ambient temperature of an electrical appliance in which the thermal cut-off fuse of this invention is incorporated rises and reaches a prescribed danger level, the thermal pellet P which has been formulated to melt at that prescribed danger temperature by accurately responding to the temperature change immediately melts. Consequently, in the continued path formed by the combination of the switch member 20, the rotating member 70 and the ratchet means 50, the union is broken between the rotating member and the ratchet means 50 which have so far retained tight engagement to each other through the medium of the frictional force of the thermal pellet P in its solid state, with the result that the rotating member 70 and the switch member 20 gain freedom of rotation. Since these two component parts are subject to the energizing force which the coil spring 40 exerts in the clockwise direction indicated by the arrow in the drawing of FIG. 5(A), they are caused to rotate by an angle of 90° until the contact projection 22 collides with the stopper 15 as illustrated in FIG. 5(B). Consequently, the electrical continuity between the two contacts is broken and the circuit is opened. Thus, the thermal cut-off fuse has discharged its role perfectly.

Another spring 30 which is found in the drawing is provided as shown for the purpose of producing mutually repulsing force to the ratchet means 50 and the switch member 20, so that the contact means 21 is always pressed against the contacts 12.

Now, a description is given as to the case where the thermal cut-off fuse of this invention which has been brought to the state of opened circuit is to be reset to the state of closed circuit.

As the supply of the electric current to the electrical appliance provided with a heat source is shut off, the radiation of heat is consequently stopped. Thus, the ambient temperature and the temperature of the thermal cut-off fuse itself are lowered. As the ambient temperature decreases, the thermal pellet solidifies to combine the switch member 20, the rotating member 70 and the ratchet means 50 into one single piece. In the meantime, however, the state of opened circuit illustrated in FIG. 5(B) persists. The fuse can be reset from this opened-circuit state into the closed-circuit state illustrated in FIG. 5(A) by manually rotating the combined group of switch member, rotating member and ratchet means by 90° in the counter-clockwise direction indicated by the arrow in FIG. 5(B), in which the catch plate 60 permits the group's rotation. After the group has been rotated by 90°, the rotation is stopped by the contact projection 22 of the contact means colliding with the stopper 15. At the same time, the resilient claw 61 drops into the groove 53 formed in the ratchet means 50 and prevents the ratchet means for rotating backward.

This operation for resetting the fuse to the closed-circuit state, of course, is to be carried out after the electrical appliance trouble responsible for the abnormal temperature increase or the cause of such trouble has been completely eliminated. When the fuse is reset as described above, it again becomes capable of sensing when the temperature has risen to the prescribed danger level and shutting off the supply of electric current to the appliance. Thus, the thermal cut-off fuse of the present invention can be used repeatedly.

Any one of several methods may be employed for the purpose of resetting the thermal cut-off fuse from its opened-circuit state to the normal closed-circuit state by externally giving a rotational force to the switch member 20 which has severed engagement with the contacts. A typical resetting means is illustrated in the diagrams of FIGS. 1–5.

In the present preferred embodiment, the afore-mentioned rotating member 70 is so adapted that when it is set in position within the housing 80, the spindle 73 formed at the leading end of the engaging member 72 is inserted into a central hole 16 bored at the center of the base 10 and allowed to support the engaging member freely rotatably. A head 74 which forms the other end of the rotating member is received in a supporting hole 82 bored in the top plate of the housing 80. Thus, the entire rotating member is rotatably fastened at its upper and lower ends. In the upper surface of the head 74, there is formed a slit 75 which permits a finger nail or a screw-driver d inserted from outside as shown in FIG. 5(B) to impart a desired rotation to the rotating member 70.

The head 74 is provided with a flange 76, which serves the purpose of preventing the rotating member 70 which enjoys freedom of axial movement from thrusting out of the supporting hole 82 of the housing 80.

Figure 6:
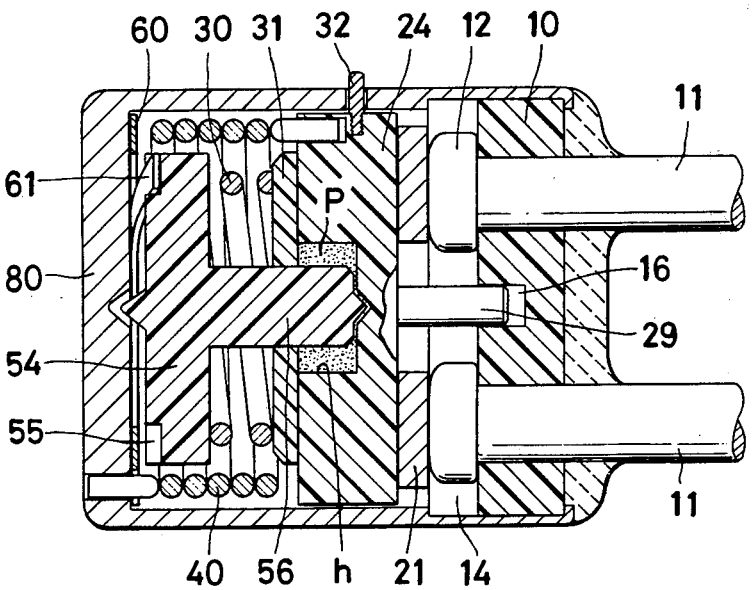
FIG. 6 is a sectioned view in side elevation of the second preferred embodiment of the thermal cut-off fuse of the present invention.
Figure 7:
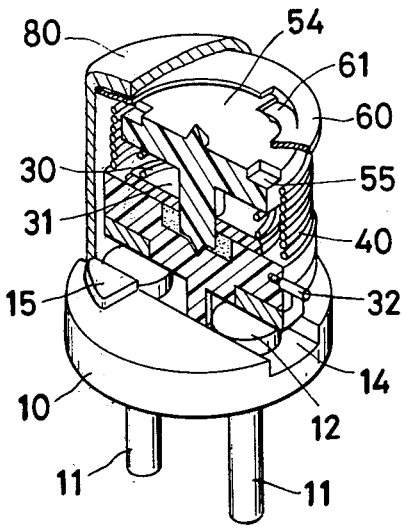
FIG. 7 is a partially cutaway perspective view of the thermal cut-off fuse of FIG. 6.
Figure 8:
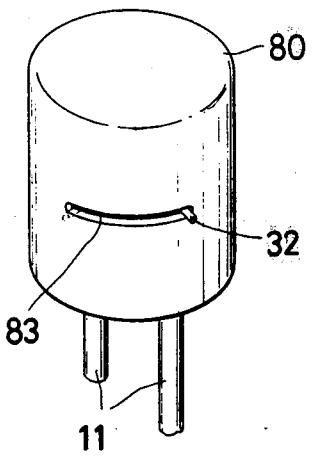
FIG. 8 is an outline drawing of the fuse of FIG. 7.

In the second preferred embodiment illustrated in FIGS. 6–8, the resetting means described above is modified with a view to further simplifying the entire construction of the thermal cut-off fuse. In this preferred embodiment, there is used a ratchet means 54 which has a structure such as is formed by the addition of the ratchet means 50 to the rotating member 70 of the first preferred embodiment. The upper part of the ratchet means 54 is in the shape of a disc which is provided along the periphery thereof with notches 55 spaced circularly by a fixed angle of 90°, whereas the lower part of the ratchet means is in the shape of a shaft 56. The notches 55 have the same effect as the grooves 53 formed in the ratchet means of the first preferred embodiment, namely it fulfils a function of causing the resilient claw 61 of the catch plate 60 fixed on the housing 80 to check the clockwise rotation of the ratchet means 54 illustrated in FIG. 7. The contact base 24 is provided at the center thereof with a hole h large enough to admit the diameter of the shaft 56. On the opposite side, it is provided with a spindle 29 adapted to engage with the central hole of the base 10 and support the switch member 20 in a freely rotatably state. The hole h in the contact base 24 is capable of receiving the shaft 56 of the ratchet means. In order for the shaft 56 to be positioned accurately at the center of this hole h, it is desirable that a pivot should be formed at the leading end of the shaft 56 and a pivot seat provided at the center of the bottom of the hole h. When a pivot is formed at the center of the upper surface of the disc of the ratchet means and a pivot seat is provided at a corresponding position on the housing 80, the catch plate 60 is allowed to rotate in one direction only. The ratchet means 54 and the contact base 24 are combined in a single piece under the normal temperature condition by interposing between the shaft 56 and the hole h the thermal pellet P which melts at the prescribed danger temperature. The switch member 20 is energized by the spring coil 40 in the clockwise direction similarly to that used in the first preferred embodiment so that the switch member is subject to a force tending to push the switch member out of the closed-circuit position of FIG. 7 to the opened circuit position, involving a rotation of 90°. Actually, however, the catch plate 60 prevents the ratchet means 54 which is combined in one piece with the switch member 20 from being rotated in the clockwise direction. Thus, the switch member is retained in the state of closed circuit.

When the ambient temperature rises and reaches the prescribed danger level which equals the melting point of the thermal pellet P, the thermal pellet P melts and the union between the ratchet means 54 and the switch member 20 is destroyed. Consequently, the switch member 20 which is energized by the coil spring 40 in the clockwise direction is allowed to rotate by 90° and collide with the stopper 15, upsetting the state of closed circuit.

Even when the supply of electric current to the electrical appliance is shut off and the ambient temperature falls enough for the thermal pellet P to solidify again, the opened circuit persists.

In the drawing, the disc 31 is intended to prevent the liquefied thermal pellet from flowing out of the hole h. The captured thermal pellet P solidifies into its original solid state and consequently combines the ratchet means 54 and the switch member 20 into a single piece.

After the trouble in the electrical appliance has been completely eliminated, desired resetting of the fuse to the state of closed circuit can be accomplished by manually rotating the switch member 20 by 90° in the counter clockwise direction. When the ratchet means 54 which is united with the switch member 20 in a single piece through the medium of the thermal pellet P is rotated by 90°, the resilient claw 61 of the catch plate drops into the groove 55 and prevents the switch member 20 from rotating backwards. In other words, the state of closed circuit is established and retained.

Figure 9:
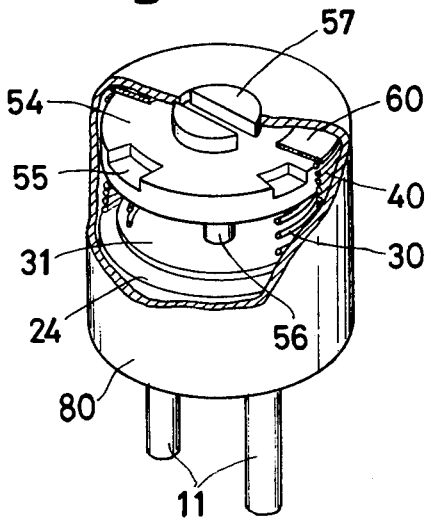
FIG. 9 is a partially cutaway perspective view of the third preferred embodiment of the thermal cut-off fuse of the present invention.

As means for enabling one to rotate the switch member 20 in the counter clockwise direction, namely as means for fulfilling the role played by the rotating member of the first preferred embodiment, as shown in FIG. 8, a lever 32 of a suitable size is disposed on the lateral side of the contact base 24 and a slit 83 is formed in the corresponding part of the housing 80 to have this lever protrude from the housing wall. When the ambient temperature rises to reach the prescribed danger level, the lever 32 moves leftwards and eventually reaches the position indicated by a dotted line, bringing the fuse to the state of opened circuit. Required resetting of the fuse to the state of closed circuit can afterward be accomplished by simply moving the lever from the position of the dotted line to that of the solid line. As in the first preferred embodiment, therefore, the thermal cut-off fuse of the second preferred embodiment, can be repeatedly reset from its state of opened circuit to that of closed circuit. Alternatively, a means used for this resetting may be formed, as illustrated in FIG. 9, by providing the ratchet means 54 on the upper surface thereof with a head 57 possessing a slit like that of the head 74 of the rotating member 70 of the first preferred embodiment provided with the slit 75, and allowing the head 57 to look out of the housing through a hole 82 formed in the upper side of the housing in a size equalling that of the head. After the trouble in the appliance has been eliminated, required resetting of the fuse to the state of closed circuit can be effected by simply inserting a screw-driver or a finger nail into the slit of the head 57 and rotating the head by 90°. Also in the present preferred embodiment, the head 57 and the hole 82 have a relationship similar to that of a shaft and a bearing.

As described above, the thermal cut-off fuse of the present invention safely retains the state of closed circuit under the normal temperature condition and, when the ambient temperature rises to reach the prescribed danger level, it immediately operates to assume the state of opened circuit by the melting of the thermal pellet which possesses outstanding accuracy of temperature response. When the ambient temperature falls and returns to the normal level again, the fuse can easily be reset from the state of opened circuit to that of closed circuit.

What is claimed is:

1. A resettable thermal cut-off fuse, comprising in combination:

a housing, a pair of contacts fixed in position at a distance from each other and connected to respective lead wires, a switch member adapted to select between the state of closed circuit and that of opened circuit between the contacts by angular rotation, a coil spring serving to energize the switch member in the circuit-breaking direction, a check means composed of a ratchet means connected freely rotatably with the switch member and provided with four grooves spaced circularly by a fixed angle of 90° and a catch plate incorporating a resilient claw adapted to engage with the groove of the ratchet means so as to prevent the ratchet means from being rotated in the direction in which it is energized by the coil spring, a thermal pellet formulated to retain a solid state under normal temperature condition and melt into a liquid state at a prescribed danger temperature level and interposed between the switch member and the check means so as to unite the movement of the switch member and that of the check means while in a solid state and break the united movement while in a molten state, and a rotating member adapted to permit the switch member, while the fuse is in the state of opened circuit, to be rotated from outside the housing in the direction opposite the direction in which the spring coil energizes the switch member, whereby the switch member which retains electrical continuity between the contacts under the normal temperature condition is released from the energizing force of the coil spring and brought into the state of opened circuit when the ambient temperature rises to reach said prescribed danger level and the thermal pellets melts at that temperature and, after the ambient temperature falls and returns to the normal level again, the switch member and consequently the fuse can be reset to the state of closed circuit by rotating the rotating member.

2. The resettable thermal cut-off fuse according to claim 1, wherein the rotating member is provided with a disc-shaped head incorporating a slit and a supporting opening matched to the head is formed in the housing to receive the head therein, whereby a suitable tool may be freely inserted into the slit of the head to impart required rotation to the rotating member.

3. The resettable thermal cut-off fuse according to claim 1, wherein the rotating member is a lever provided on the lateral side of the switch member and a slit is formed at the corresponding position on the lateral side of the housing to permit protrusion of the lever from the housing, whereby the switch member can be freely rotated from outside.

* * * * *